United States Patent [19]

Brotzmann et al.

[11] 4,330,326

[45] May 18, 1982

[54] METHOD AND A MEANS FOR INTRODUCING CLOSE-GRAINED CARBONACEOUS FUELS INTO A MOLTEN IRON BATH

[75] Inventors: Karl Brotzmann; Hans-Georg Fassbinder, both of Sulzbach-Rosenberg, Fed. Rep. of Germany

[73] Assignee: Eisenwerk-Gesellschaft Maximilianshütte mbH., Sulzbach-Rosenberg, Fed. Rep. of Germany

[21] Appl. No.: 177,162

[22] Filed: Aug. 11, 1980

[30] Foreign Application Priority Data

Aug. 24, 1979 [DE] Fed. Rep. of Germany ..... 2934333
Dec. 11, 1979 [DE] Fed. Rep. of Germany ..... 2949801

[51] Int. Cl.[3] ..... C21C 5/34

[52] U.S. Cl. ..... 75/60; 75/52; 75/59

[58] Field of Search ..... 75/52, 60, 59

[56] References Cited

U.S. PATENT DOCUMENTS

| | | | |
|---|---|---|---|
| 3,751,242 | 8/1973 | Knuppel | 75/52 |
| 4,045,213 | 8/1977 | Leroy | 75/59 |
| 4,089,677 | 5/1978 | Spenceley | 75/59 |

*Primary Examiner*—P. D. Rosenberg
*Attorney, Agent, or Firm*—Lawrence I. Field

[57] ABSTRACT

A method and a means for introducing close-grained carbonaceous fuels, which are suspended in a carrier gas, and oxygen into a molten iron bath are described.

In this method the fuel and the oxygen can be alternately introduced through the same introduction passage of a tuyere into a molten iron bath below the surface of the bath.

The means provides for alternate supply of fuel or oxygen and is regulated by means of the oxygen line pressure.

11 Claims, 1 Drawing Figure

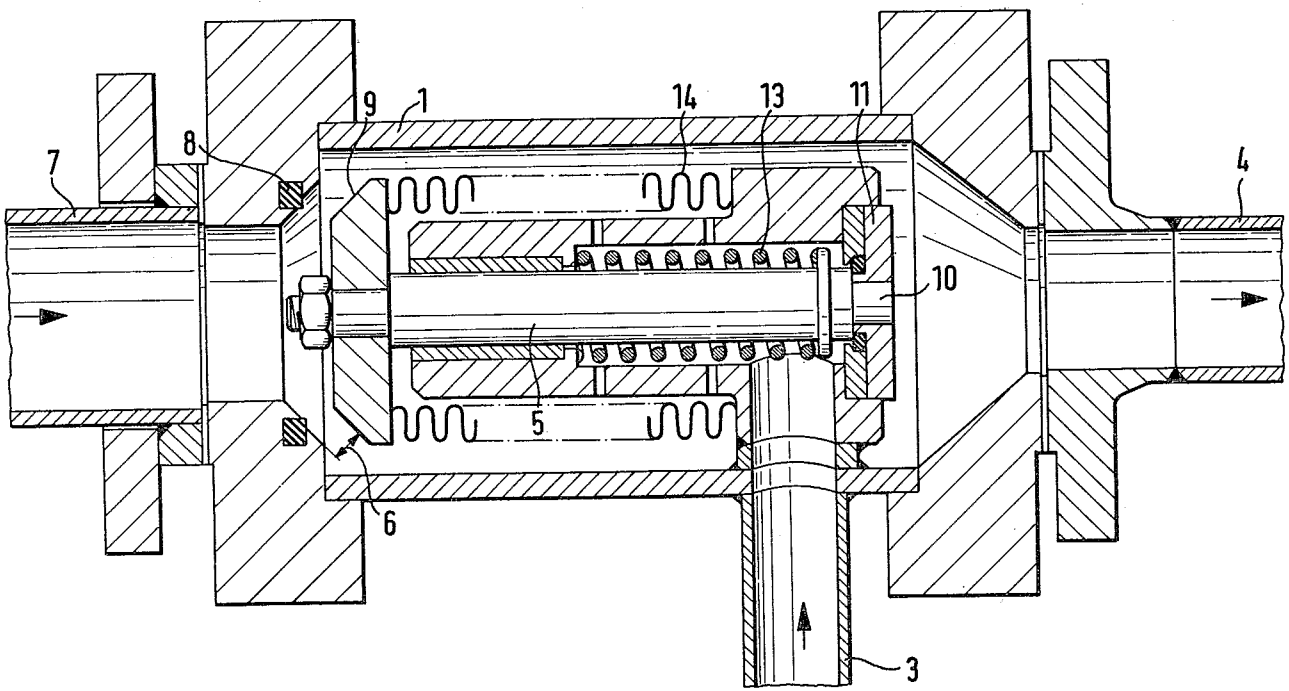
4
10
11
13
14
1
9
8
7
3
5
6

METHOD AND A MEANS FOR INTRODUCING CLOSE-GRAINED CARBONACEOUS FUELS INTO A MOLTEN IRON BATH

This invention concerns a method and a means for introducing close-grained carbonaceous fuels, such as coal and coke dust, which are suspended in a carrier medium, and oxygen into a molten iron bath below the surface of the bath through tuyeres disposed in the refractory brickwork of the converter vessel.

Methods for introducing pulverized or granulated solid materials into a molten iron bath by means of a carrier gas are known. By way of example, lances are used for blowing them into the bath, and their outlet openings extend almost to the surface of the bath, so that the materials are introduced into the molten bath with the output pulse, or the lances are submerged in the iron bath.

Furthermore, tuyere arrangements are known which are arranged below the surface of the bath in the refractory brickwork and through which solid materials suspended in carrier gases are supplied to the melt.

By way of example, German laid open application No. 23 16 768 describes a method and a means for refining hot metal, in which oxygen and powdered lime are supplied to the melt through tuyeres disposed below the surface of the bath and solid carbon carriers are fed through other tuyeres. A tuyere with a multiple of openings can be provided and in this case one opening is charged with carrier gas and carbon or powdered ore and the other opening is charged with refining gas and powdered lime.

German Pat. No. 2 401 540 describes a method for smelting sponge iron. In this method the reagents, namely oxygen, pulverized carbon and close-grained sponge iron, are also supplied to the melt below the surface of the bath, e.g. through a sheathing gas tuyere. The tuyere has a plurality of supply passages, in which case, e.g., oxygen flows through the inner passage, carbon through the middle passage and sponge iron through the outer passage. The carbon and sponge iron are suspended in a suitable carrier gas, such as carbon monoxide.

German laid open application No. 25 20 883 describes a method and a means for the continuous gasification of coal. The reagents, preferably close-grained coal and oxygen, are supplied to the molten iron bath through tuyeres disposed below the surface of the bath, which are arranged in the refractory brickwork and are as a result subject to the same amount of wear. The conveying gas for the carbon can be either inert gas, nitrogen, $CO_2$ or water vapour. The reagents may be passed through a multi-passage tuyere, preferably comprising concentric pipes. This publication mentions for the first time the possibility of mixing the reagents oxygen and carbon within the tuyere a short distance before the tuyere orifice.

German laid open application No. 27 23 857 refers to a method and a means for manufacturing steel. In this case solid, carbonaceous material is introduced into the melt below the surface and an oxidizing gas is introduced into the vessel. The carbonaceous material is blown in through blow pipes by means of a carrier gas. The carrier gas may be a reducing, oxidizing or inert gas. In this method the oxygen is normally supplied to the metallurgical vessel through a water-cooled lance. However, it is also possible to supply the oxygen by means of blowpipe injection or by means of injection using a submerged lance. The description of this reads as follows in the aforementioned laid open application: "If blowpipes are used for injecting oxygen and/or solid, carbonaceous materials the blowpipes may comprise two or more concentric pipes and a circular fluid screening, which surrounds the primary injection pipe. This screening flow medium may be an inert gas or a liquid, e.g. hydrocarbon gas or a liquid, or an oxidizing gas or a liquid, and the flow medium can be selected such that the wear of the lining and the blow pipes is kept as low as possible in order to avoid blockage of the blowpipes. The blowpipes can be embodied such that they are capable of supplying both oxidizing gas and solid, carbonaceous material." Embodiment example 1 of this specification states that particulate graphite was blown in at a rate of 3.5 kg/min for a period of 17 minutes. The blowpipes used for blowing in the carbon had a circular cross-section and were charged as follows: screening gas: air at a rate of 7 $m^3/h$; carrier gas: argon at a rate of 30 $m^3/h$. The diameter of the core of the blowpipe amounted to 7 mm with an annular passage amounting to 1 mm.

The known methods for introducing carbonaceous fuels into an iron melting bath are similar in that finely ground solid materials are supplied to the melt while being suspended in a carrier gas and separated from the oxygen by means of additional supply passages. The cross-section of the supply passages is adapted to the conveyed amount and is accordingly small, the diameter of the above-mentioned blowpipe being 7 mm, for example.

The danger of obstruction, however, increases with the reduction of the conveying cross-section. The danger of lump formation, which gives rise to obstruction in the narrow supply pipes, will mainly arise, if close-grained fuels with various degrees of granulation and various distribution of the grain sizes are used for economic reasons with high charge ratios of solid materials to carrier gas.

A further difficulty in the case of the known method of introduction is the problem of keeping the supply passages free from obstruction during periods in which no fuel is conveyed, e.g. at the finishing refining stage of a steel melt when the desired low final content of carbon is adjusted. During the refining period the carrier gas usually flows without solid material through the supply passages in order to prevent the melt from penetrating into the tuyeres. The carrier gas, however, removes some of the heat from the melt and moreover, depending on the type of gas used, it may have an adverse effect on the composition of the steel, e.g. due to increased levels of nitrogen in the finished steel.

In practical operation it has turned out to be particularly important to operate the supply passages for carbonaceous fuels reliably and troublefree for long periods, e.g. when operating an iron bath reactor for producing a gas for a period of several months and when producing steel for approximately 1000 melts, since all repair work carried out, e.g. when a tuyere becomes obstructed, will mean a loss of production time and will result in grave economic disadvantages.

It is therefore the object of the invention to provide a method and a means for introducing close-grained, carbonaceous fuels, such as coal and coke dust, into an iron melting bath, in which the reliable and troublefree supply of fuels beneath the surface of the bath is guaranteed for long periods and in which obstruction of the tuyeres is avoided and the tuyeres are kept free during periods of operation in which no fuel is conveyed.

In accordance with the invention this object is achieved by alternately supplying fuel and oxygen through one and the same introduction passage of the tuyere.

One subject of the invention is a method for introducing close-grained, carbonaceous fuels, which are suspended in a carrier gas, and oxygen into a molten iron bath below the surface of the bath through tuyeres disposed in the refractory brickwork of the converter vessel which is characterized in that the fuel and oxygen are alternately supplied through one and the same introduction passage of the tuyere.

Another subject of the invention is furthermore a means for introducing close-grained, carbonaceous fuels, which are suspended in a carrier gas, and oxygen into a molten iron bath, comprising a movable valve member disposed in a housing having a fuel supply line, an oxygen supply line and a tuyere pipe, said valve member clearing the cross-section of the openings for the fuel and the oxygen and being regulated by the oxygen line pressure.

The inventive method is distinguished by a high degree of reliability in operation and the tuyeres for introducing close-grained, carbonaceous fuels below the surface of the bath do not become obstructed. As soon as irregularities crop up in respect of the throughput amount of carbonaceous fuels, e.g. if the conveyed amount is reduced, the conveyance of fuel is switched over to oxygen for a short period and the tuyere passage is blown free. The formation of accretions at the orifices of the tuyeres, which are often a cause of obstruction, are burnt off by the oxygen flow. Extremely short oxygen blow periods of from 0.1 to about 2 min., e.g., are sufficient to blow the tuyeres free. The oxygen blow periods can be optionally varied and can be extended in particular before the supply of fuel and carrier medium is restarted.

In accordance with the invention the change over from fuel to oxygen can be carried out several times within short periods of time. This mode of operation is particularly meaningful when the oxygen blow periods are to be short. As soon as the fuel conveyance again runs troublefree after a short oxygen blast of ten seconds, for example, oxygen need no longer be added. Otherwise, a short blast of oxygen can be given as often as is necessary. The switch-over from oxygen blowing to the conveyance of the suspension, e.g. nitrogen and coal dust, is carried out almost without inertia by means of appropriate reversing means which are disposed in the immediate vicinity of the tuyere assembly flange, and at all events directly at the bottom of the treatment vessels, such as for example in a iron bath reactor or in a converter for the production of steel.

A simple form of the tuyere for introducing the suspension of close-grained, carbonaceous fuels and a carrier medium, on the one hand, and oxygen on the other hand, comprises two concentric pipes in the case of which the fuel and the oxygen alternately flow through the central pipe. The annular passage formed between the central pipe and the second concentric pipe is charged, e.g., with 0.5 to 5% by weight, in relation to the oxygen, of gaseous and/or liquid hydrocarbons in order to protect the tuyere against premature burning back. This tuyere is normally installed below the surface of the bath in the refractory brickwork and will essentially burn back at the same rate as the brickwork itself.

In accordance with the invention the danger of the tuyeres becoming obstructed when carbonaceous pulverized fuels are introduced into a molten iron bath is practically eliminated, and for this reason the installation of the actually required blowing cross-section for introducing the suspension is sufficient, i.e. the additional installation of further fuel supply tuyeres for safety reasons is no longer necessary. By way of example, it has turned out to be completely sufficient in the case of a converter working according to the basic oxygen process to only convert two of ten oxygen supply tuyeres in the converter bottom for the supply of close-grained coal or coke. Approximately 2000 kg coal dust can be supplied to an iron melt of about 65 t within 10 min using these two tuyeres. Nitrogen, for example, may be used as a carrier medium, and the charging rate amounts to 12 kg coal dust/$Nm^3$ nitrogen. The addition of fuel serves to increase the heat balance in order to enhance the scrap melting capacity in the production of steel.

In the known method for introducing finely crushed carbonaceous fuels into an iron melt supply pipes with an inside diameter of 10 mm are disposed in the center of each of the ten above-mentioned oxygen supply tuyeres as conveying passages for the fuel-carrier gas suspension. As is quite common, the oxygen supply tuyeres themselves are constructed from two concentric pipes, the inner pipe with an interior diameter of 24 mm serving as a supply pipe for oxygen or oxygen and powdered lime. The arrangement of the fuel supply passages in the oxygen pipe has turned out to be a drawback for a number of reasons. The installation and maintenance of the ten fuel supply pipes is technically expensive but none the less necessary in the case of this method of supplying fuel in order to maintain a sufficient conveying diameter for the carbonaceous fuel in working order in the case of trouble at individual supply passages, e.g. obstructions. Obstructions at individual fuel supply passages cropped up in almost every charge. Moreover it turned out to be particulary unfavourable to have to keep these passages free by means of carrier gas, when the supply of fuel was cut off towards the end of the refining period. The nitrogen used for conveying the fuel led to undesired high nitrogen content in the steel melt. Other carrier gases, e.g. argon or methane, are expensive and furthermore require costly installations in the converter unit for a further medium. Nitrogen is commonly at hand on a basic oxygen converter. Moreover the carrier gas bubbles lead to a worsening of the heat balance in the production of steel when not charged with fuel. The heat for heating of the carrier gas is lost as energy for the melting of scrap.

By way of example, the method in accordance with the invention permits a further increase in the safety in operation of an iron bath reactor for the continuous gasification of coal, as described in German laid open application No. 2 520 883. Large amounts of coal are converted to gas, which essentially comprises CO and $H_2$, in this kind of iron bath reactor. The reagents, coal dust and oxygen, are normally supplied through tuyeres from a plurality of concentric pipes disposed below the surface of the iron bath. Normally the suspension comprising finely ground coal and a carrier gas, e.g. $CH_4$, flows through the central pipe, oxygen flows through the annular passage surrounding the central pipe and the tuyere protective medium, e.g. natural gas, flows through a further annular passage. Normally these tuyeres function troublefree, but sometimes accretions are formed at the orifice of the tuyere of the central pipe, and these lead to a reduction of the amount of coal dust conveyed. Since, however, the iron bath reactor should have very even rates of gas production, the speedy solution of such trouble in the conveyance of coal is of particular importance. The inventive change-over from coal dust to oxygen in the fuel supply passage of the nozzle permits resumption of the normal coal supply after a relatively short amount of time, generally amounting to less than 1 min, for example.

A particularly advantageous application of the invention is its combination with the method for supplying heat in the production of steel in a converter, described in German patent application No. P 28 38 983.5. In the production of steel in a converter heat is added in accordance with this method by means of carbonaceous fuels and particularly these fuels are exploited in the melt with a high degree of pyrometric efficiency which could not be achieved up to then. Thus the economic melting of solid iron carriers, e.g. scrap, is considerably enhanced and even goes as far as the production of steel without liquid hot metal. In this method the oxygen for refining the melt and for burning the fuel is introduced at one and the same time into the converter below the surface of the bath as gas jets directed towards the surface of the bath. In particular coke, brown coal coke, graphite, coal of different qualities and mixtures thereof are used as carbonaceous fuels.

These carbonaceous fuels are introduced, preferably in powder form, below the surface of the bath into the iron melt of the converter together with a carrier gas. Nitrogen, CO, $CH_4$ or natural gas and inert gas, e.g. argon, have been successful as carrier gases. In accordance with the above-mentioned German patent application the suspension comprising carbonaceous fuels and a carrier gas can be supplied through one or more tuyeres in a basic oxygen converter, while the supply pipes of individual tuyeres are charged with the suspension comprising fuel and carrier gas instead of oxygen.

The method in accordance with the present invention has now overcome the drawbacks existing heretofore and associated with the supply of close-grained carbonaceous fuels to an iron or steel melt. These drawbacks were a disadvantage of the otherwise very advantageous process of heat supply in accordance with German patent application No. P 28 38 983.5.

Apart from the advantages of the inventive method already described, one further advantage for the production of steel should be noted. By using the oxygen supply pipes of one or more tuyeres in the basic oxygen process for supplying close-grained carbonaceous fuels during the fuel supply period and the subsequent change-over to oxygen, an accordingly larger blowing cross-section for the oxygen is present for the end refining phase, i.e. the phase without fuel supply. Thus this refining phase is shortened and this results in a reduced overall refining time. This means a further benefit for the production of steel.

The inventive method and the inventive means are suitable for supplying various close-grained fuels, e.g. coal of various qualities, coke, brown coal coke, graphite, refinery residue and mixtures of these fuels. The fuels are introduced either pulverized or granulated and the granulation size and the distribution of the granulation sizes may vary within wide limits.

In particular inert gases, such as argon, nitrogen, carbon monoxide, carbon dioxide, hydrocarbons such as methane, natural gas and water vapour are suitable as carrier gases.

The inventive method and means are not limited to the introduction of oxygen but are also suitable for the introduction of other oxygen-containing gases, in particular air, and mixtures of oxygen and other gases, in particular oxygen and argon.

In accordance with a preferred embodiment only some of the total number of tuyeres, which are arranged below the surface of the bath in a treatment vessel, e.g. an iron bath reactor for the production of gas or a basic oxygen converter for the production of steel, are used as supply tuyeres for the carbonaceous fuels.

The inventive method will now be described in more detail with reference to a non-limiting example for the production of steel with an increased amount of scrap.

A 60 t basic oxygen converter equipped with 10 tuyeres in the converter bottom and one tuyere in the upper converter wall for oxygen top blowing is charged with 30 t scrap of ordinary commercial quality and 44 t hot metal comprising 4.2% carbon, 0.6% silicon, 0.8% manganese, 0.3% phosphorus, 0.03% sulphur and at a temperature of 1250° C.

Two of the bottom tuyeres are equipped for the application of the inventive method, i.e. fuel and oxygen can be alternately supplied through the same supply passage of the tuyere.

At the beginning of refining approximately 10.000 $Nm^3/h$ oxygen are fed to the melt through eight bottom tuyeres and about the same amount of oxygen is fed to the melt through the top blowing tuyere in the upper converter wall. At the same time 200 kg/min powdered coke is fed to the melt through two bottom tuyeres together with 16 $Nm^3/min$ nitrogen.

After about 10 min the melt has been fed in this manner with approximately 2000 kg coke and the two fuel supply tuyeres are switched over to oxygen.

After a blowing time of about 15 min the refining operation is concluded, and after a subsequent correction blowing of about 2 min the steel melt is tapped having a composition of about 0.02% carbon, 0.1% manganese, 0.025% phosphorus, 0.02% sulphur and a temperature of 1670° C.

The total charge follow-up time amounts to about 40 min. In all, the melt was fed with 4600 $Nm^3$ oxygen, 100 $Nm^3$ propane for protecting the tuyeres, 150 l oil for a two-minute period of preheating the scrap and 2000 kg coke. The weight of the tapped charge amounts to 64 *t*.

It will be clear that this mode of operation described by way of example can be modified in many ways, in particular as regards the supply of close-grained carbonaceous fuels. For example in the case of a charge in the basic oxygen converter the supply of fuel can be cut off for a short time and oxygen can be blown through the fuel supply passage.

The inventive method, in which a change-over is made from fuel to oxygen and vice versa in the same tuyere passage, can also be applied to other processes in which carbonaceous fuels are supplied to an iron melt.

The inventive means for alternately introducing close-grained carbonaceous fuels and oxygen will now be explained in more detail.

The pressure present in the oxygen supply system, i.e. the oxygen inlet pressure which generally amounts to approximately 20 bar, serves to reverse the valve. The oxygen inlet pressure is produced in the valve itself until it reaches the oxygen blowing pressure of the tuyere. In the case of applied oxygen inlet pressure the movable valve member only opens the oxygen aperture cross-section for the tuyere. In the case of a reduction of the applied oxygen inlet pressure by a given amount, which can be set by means of a spring, ranging from 0.5 to 10 bars, preferably 2 bars, above the oxygen blowing pressure of the tuyere, only the fuel aperture cross-section to the tuyere is open.

In order to ensure reliable reversal from fuel to oxygen and in particular to avoid having pipes through which fuel and oxygen flow after each other, the inventive reversing valve is mounted in the immediate vicinity of the tuyere on the converter, preferably between the converter pivot and the tuyere and particularly as a structural unit with the tuyere itself. The reversing valve is preferably arranged directly on the mounting flange for the tuyere.

Normally the reliable dualpipe tuyeres with protective medium sheathing are used as tuyeres. In this tuyere embodiment oxygen normally flows through the central pipe. With the inventive reversing valve it is possible to alternately supply oxygen or fuel through this tuyere passage, i.e. in this case the central tuyere pipe, and to switch over from fuel to oxygen as often as desired. A protective medium flows through the annular passage between the inner and a second outer tuyere pipe for protecting the tuyere against premature burning back in the refractory brickwork in which it is normally installed. Gases and/or liquids can be used as a protective medium. The use of hydrocarbons, such as methane, natural gas, propane, butane, light fuel oil and other types of oil is preferred. The proportion of hydrocarbons in relation to the oxygen throughput is low, amounting to between 1 and 5% by weight.

The use of the reversing valve in accordance with the invention is, however, not limited to this type of tuyere but can instead be used for any supply tuyere in the converter area for switching over from oxygen-containing media to fuels and/or pneumatically conveyable materials. The reversing valve may, for example, be used in conjunction with the so-called circular slot tuyere described in German Pat. No. 2 438 142.

A preferred application of the inventive reversing valve is the operation of certain dualpipe tuyeres, e.g. two from a total of 10 which are installed in the converter bottom of a basic oxygen converter, for a short period with oxygen and then for a longer period of, for instance, 8 min with a suspension comprising powdered carbonaceous fuels and a carrier gas and subsequently, at the end of the refining period, e.g. 5 min, to supply oxygen again. Coke, brown coal coke, graphite, coal of different qualities and mixtures thereof in a finely ground state with a granulation of up to approximately 1 mm have been successful as carbonaceous fuels. The reversing valves have turned out to be extremely reliable in operation and were used, by way of example, in the manner described without any breakdown occurring in more than 1000 charges.

Valves for medium reverse, which can be regulated either pneumatically or electrically are commercially available and are commonly used. The known valves for reversing, however, require an additional pipe for the regulating medium. The installation of the known valves directly on a converter for the production of steel produces difficulties due to the relatively high ambient temperature extending up to 300° C. and, furthermore, due to the necessity of a further regulating pipe. These pipes must be laid to the converter through a rotary transmission in the converter pivot.

These drawbacks are avoided in the case of the inventive reversing valve, since the medium applied in the converter, namely oxygen, is used directly for regulating the valve. An additional regulating medium or an electric conductor is thus not necessary. The oxygen is conveyed with the system pressure, i.e. the inlet pressure, up to the reversing valve. The complete oxygen inlet pressure, which normally amounts to approximately 20 bars, is exploited in the valve for regulating the movable valve member. Other pressure values, independent of the oxygen supply system, are naturally also suitable.

The oxygen pressure acts in the valve on a movable valve member which closes the fuel aperture cross-section to the reversing valve gas-tight. At this position of the movable valve member only oxygen can flow through the oxygen aperture cross-section to the tuyere. The oxygen aperture cross-section is dimensioned such that it acts as a throttle member and reduces the oxygen input pressure down to the oxygen tuyere pressure. Due to this pressure reduction, which may for example be from 20 bars input pressure to 4 bars tuyere pressure, the oxygen aperture cross-section also determines the amount of oxygen flow.

The oxygen aperture cross-section is fixedly adjusted on the reversing valve. This setting may, however, be relatively simply changed in accordance with the desired states of pressure.

As soon as the oxygen inlet pressure is reduced, i.e. when the oxygen supply is cut off and the pipe depressurized, the inventive reversing valve switches over with the aid of the movable valve member. The oxygen aperture cross-section is closed gas-tight and the fuel aperture cross-section is opened. The difference in pressure between the oxygen inlet pressure, e.g. 20 bars, and the reduction of the oxygen inlet pressure, in the case of which the switching operation is initiated, is set in the reversing valve by means of a spring in the valve at a value between 0.5 and 10 bars, preferably 2 bars, above the oxygen blowing pressure of the tuyere, e.g. 4 bars, and amounts as a result to 6 bars, for example. This initiation of the reversing process by means of a pressure difference within the given limits of 0.5 and 10 bars above the oxygen blowing pressure of the tuyere has the advantage that in the case of slow pressure reduction in the oxygen inlet pressure pipe the movable valve member will not assume an intermediate or fluttering position at which both oxygen and fuel could flow simultaneously into the tuyere passage.

The oxygen supply pipe is preferably in communication with a valve chamber with a partition which on the application of oxygen gas pressure permits a change in the length of the valve chamber, and the movable end of the valve chamber is connected to a dual-action valve member, which monitors the fuel aperture cross-section, on the one hand, and the oxygen aperture cross-section on the other hand, and the valve member is pre-loaded such that the oxygen aperture cross-section is closed.

The valve member can be preloaded by means of a spring or by any other means capable of producing this effect, such as for instance pneumatic inlet pressure.

The valve member is preferably coaxially disposed in the fuel supply pipe.

The partition is preferably formed by a bellows.

The part of the means through which oxygen flows are preferably sealed off gas-tight against the parts through which fuel flows.

A throttle member is preferably provided, which determines the oxygen aperture cross-section.

The inventive means will now be explained in more detail by means of an exemplary embodiment example and with reference to the drawing.

The FIGURE shows a longitudinal sectional view of one embodiment example of the inventive reversing valve.

The reversing valve comprises a stationary housing 1 (slanted shading) with an oxygen supply pipe 3, in which the oxygen inlet pressure prevails when oxygen is fed to the tuyere pipe 4. In the position of the movable valve member 5 illustrated (longitudinal shading) no oxygen pressure is applied and the fuel aperture cross-section 6 is open so that the fuel, e.g. a coal/nitrogen suspension, can flow out of the fuel pipe 7 to the tuyere pipe 4.

Nitrogen or an inert gas, e.g. argon, may serve, for example, as a conveying gas for the powdered carbon, e.g. coke. When unloaded, the conveying gas has a pressure of about 3 bars and when completely loaded with 17 kg carbon per $Nm^3$ a pressure of about 12 bars.

As soon as the oxygen supply pipe 3 is pressurized with the oxygen inlet pressure, e.g. 20 bars, the movable valve member 5 moves in the direction of the fuel supply pipe 7 and closes the fuel aperture cross-section 6 by means of the sealing means 8 in conjunction with the abutment surface 9. The oxygen aperture cross-section 10 is opened and oxygen flows into the tuyere pipe 4. In order to achieve the desired pressure reduction from the oxygen inlet pressure (20 bars) to the oxygen tuyere pressure, e.g. 3 bars, the oxygen aperture cross-section 10 may be accordingly set by means of various bore diameters 10 in the perforated disc of the throttle member 11.

As soon as the oxygen inlet pressure has sunk by an adjustable pressure difference between 0.5 and 10 bars above the blowing pressure of the tuyere 4 (0.5 to 10 bars+blowing pressure), the movable valve member 5 returns to the position as illustrated and opens the fuel aperture cross-section 6. The difference in pressure for initiating the reversing operation is set in the described embodiment by means of the force of the spring 13.

It should be noted that the parts through which oxygen flows are closed gas-tight when fuel is being conveyed and the metal bellows 14 allows the necessary movement of the movable valve member 5 when reversing.

Structural deviations from the described embodiment example of the reversing valve are within the scope of the invention, in particular as long as the essential feature of the invention, namely the regulation of the valve by means of the oxygen inlet pressure, is realized.

What we claim is:

1. A method for introducing close-grained carbonaceous fuels, which are suspended in a carrier gas, and oxygen into a molten iron bath below the surface of the iron bath through the same supply passage of tuyeres arranged in the fire-resistant brickwork of the treatment vessel, comprising alternately introducing said carbonaceous fuel suspended in a carrier gas and said oxygen into said molten iron bath through the said supply passage in said tuyeres.

2. A method according to claim 1 wherein a reversal is made once or several times between fuel and oxygen during a period of treatment of the iron melt.

3. A method according to claim 1 or 2 wherein the oxygen is introduced while being sheathed by liquid or gaseous hydrocarbons.

4. A method according to any one of claims 1 to 3 wherein the fuel and the oxygen are introduced through the central pipe of a tuyere comprising concentric pipes.

5. The method of claim 1 wherein the close-grained carbonaceous fuels, which are suspended in a carrier gas, and oxygen are introduced into said iron melt by a means comprising a movable valve member in a housing having a fuel supply pipe, an oxygen supply pipe and a tuyere pipe, said valve member selectively opening the fuel aperture cross-section or the oxygen aperture cross-section and being regulated by means of the pressure of the oxygen in the supply pipe.

6. The method of claim 5 wherein said oxygen supply pipe communicates with a valve chamber having a partition which, under the action of oxygen gas pressure, permits a change of the length of the valve chamber, the movable end of the valve chamber is connected to a dual-action valve member which monitors said fuel aperture cross-section, on the one hand, and said oxygen aperture cross-section, on the other hand, and said valve member is preloaded such that said oxygen cross-section is normally closed.

7. The method of claim 5 or 6 wherein said valve member is disposed coaxially in said fuel supply pipe.

8. The method of claim 5, 6 or 7 wherein said partition is formed by a bellows.

9. The method of claim 5, 6, 7 or 8 wherein the parts of the means through which oxygen flows are sealed gas-tight against the parts through which fuel flows.

10. The method of claim 5, 6, 7, 8 or 9 wherein a throttle member is provided, which determines said oxygen aperture cross-section.

11. A method according to claim 1, wherein at a drop of the throughput of carbonaceous fuel the material introduced through said supply passage is changed to a short period introduction of oxygen or oxygen containing gas.

* * * * *